United States Patent [19]

Yamanaka

[11] 4,003,570

[45] Jan. 18, 1977

[54] CONVEYOR FOR TRANSFER SHEET FIXING APPARATUS

[75] Inventor: Masanori Yamanaka, Tokyo, Japan

[73] Assignee: Ricoh Co., Ltd., Tokyo, Japan

[22] Filed: July 14, 1975

[21] Appl. No.: 595,987

[30] Foreign Application Priority Data

July 19, 1974 Japan ..... 49-82941

[52] U.S. Cl. ..... 271/265; 271/269; 271/271

[51] Int. Cl.[2] ..... B65H 7/02

[58] Field of Search ..... 355/3 R; 271/233, 265, 271/269, 271

[56] References Cited

UNITED STATES PATENTS

| | | | |
|---|---|---|---|
| 1,888,659 | 11/1932 | Eckhard | 271/269 |
| 3,369,807 | 2/1968 | Whelan | 271/269 |
| 3,603,680 | 9/1971 | Barton | 355/3 |
| 3,716,294 | 2/1973 | Knechtel | 271/265 X |
| 3,795,442 | 3/1974 | Kimura | 355/3 R |
| 3,879,030 | 4/1975 | Hommerin | 271/269 X |

*Primary Examiner*—Richard A. Schacher
*Attorney, Agent, or Firm*—Frank J. Jordon

[57] ABSTRACT

A table is detachably mounted to a fixing apparatus adjacent to and aligned with an inlet opening thereof. The table is formed with a longitudinal slot through which a pusher member vertically extends. A transfer sheet is placed on the table, and drive means reciprocally move the pusher member to push the transfer sheet into the fixing apparatus and return the pusher member to its original position.

13 Claims, 3 Drawing Figures

CONVEYOR FOR TRANSFER SHEET FIXING APPARATUS

The present invention relates to a conveyor for pushing a transfer sheet into a transfer sheet fixing apparatus as utilized in electrostatography and offset printing.

An electrostatographic apparatus or copying machine is generally provided as a single unit which performs the functions of imaging photoconductive member to produce an electrostatic image of an original document, developing the electrostatic image using a dry or liquid toner to produce a toner image, transferring the toner image to a transfer or copy sheet and thermally or otherwise fixing the toner image to the transfer sheet. It is advantageous, however, especially in critical applications to provide the fixing apparatus separately from the other ports of the apparatus. Such a configuration allows cleaning or corrections to the toner image on the transfer sheet prior to fixing. A similar fixing apparatus is utilized in offset printing in fixing a transfer image onto an offset master plate.

Prior art means for feeding a transfer sheet or plate into a fixing apparatus include the use of pinch rollers to grip the opposite edges of the transfer sheet. The rollers obviously cannot grip the entire sheet since they would smear the transfer image. In addition to the drawback that pinch rollers which engage with the edges of a transfer sheet cannot be used with transfer sheets in which the transfer image covers the entire surface of the sheet, this type of roller assembly often fails to feed the sheets in the proper direction and tends to crimp or crease the edges of the sheets.

A second prior art feed means includes a moving belt on which the sheets are placed. This system also fails to feed the sheets in the proper direction, or more specifically fails to feed the sheets in such a manner that the egdes of the sheet are parallel to the feed direction. A guide member engaging with the top of the sheets would be of course smear the transfer image.

It is therefore an object of the present invention to provide a conveyor for a transfer sheet fixing apparatus which overcomes the drawbacks of the prior art.

It is another object of the present invention to provide a conveyor for a transfer sheet fixing apparatus which comprises a table detachably connected to the apparatus housing near the inlet opening thereof and formed with a longitudinal slot, a pusher member vertically extending through the slot and drive means for reciprocally moving the pusher member so as to push a transfer sheet into the fixing apparatus and then return the pusher to its original position.

It is another object of the present invention to provide a conveyor for a transfer sheet fixing apparatus which automatically feeds a transfer sheet through the apparatus in the correct direction and orientation.

The above and other objects, features and advantages of the present invention will become clear from the following detailed description taken with the accompanying drawings, in which.

Figure 1:
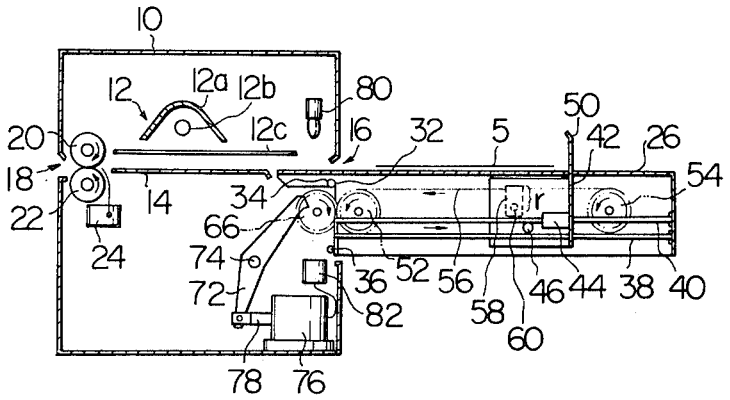
FIG. 1 is a longitudinal sectional view of a transfer sheet fixing apparatus and a conveyor according to the present invention.
Figure 2:
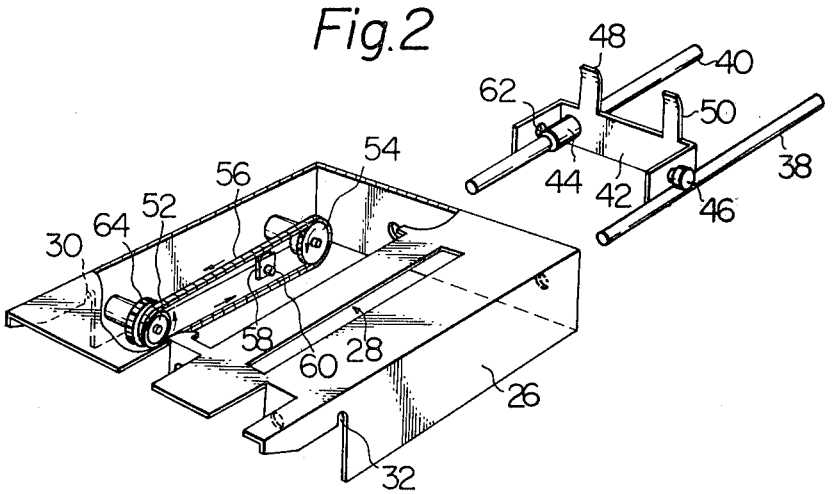
FIG. 2 is a partially exploded perspective view of the conveyor.

Referring now to the drawings, a fixing apparatus housing 10 supports therein a heater assembly 12 which comprises an infrared light source 12*b*, a reflector 12*a* and a radiator plate 12*c*. The radiator plate 12*c* is arranged above and parallel to a horizontal plate 14 on which a transfer sheet 5 such as utilized in electrostatography or offset printing slides through the housing 10. The housing 10 is formed with inlet and outlet openings 16 and 18 which are longitudinally aligned with other and with the plate 14. The transfer sheets 5 are adapted to be moved from right to left through the housing 10 or from the inlet opening 16 to the outlet opening 18 as viewed in FIG. 1. A pinch or feed roller assembly comprising pinch rollers 20 and 22 is disposed near the outlet opening 18 and controlled by a position sensor microswitch 24 which senses the position of the sheets 5 as will be described in detail below.

Figure 3:
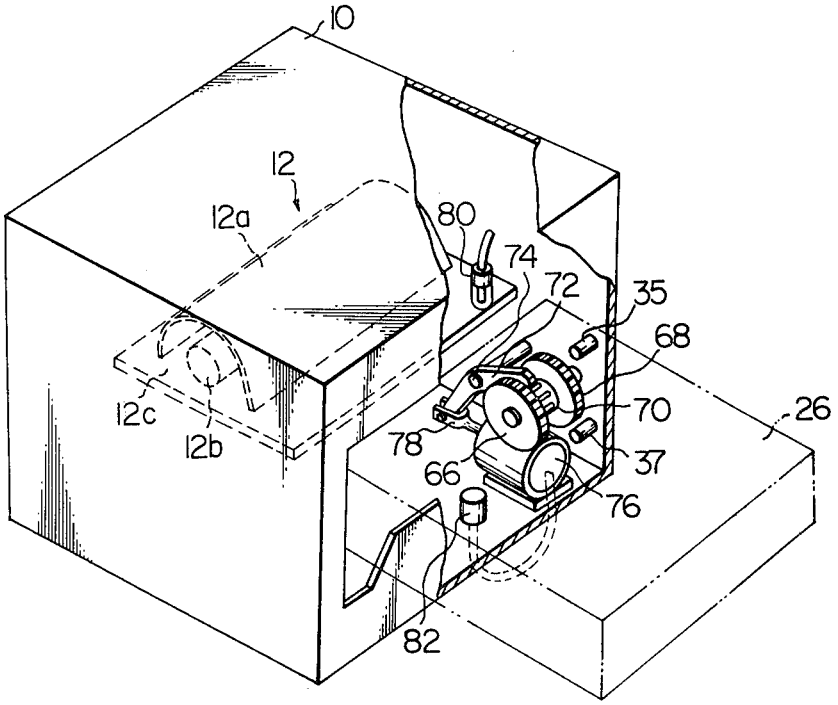
FIG. 3 is a perspective view of the fixing apparatus.

A table 26 is detachably mounted to the housing 10 and is formed with a slot 28 and another slot which is not visible in the drawings which are longitudinally aligned with the inlet and outlet openings 16 and 18. The table 26 is formed with notches 30 and 32. The notch 32 fits over a pin 34 on the housing 10 and the notch 30 fits over a similar pin 35 (see FIG. 3). The table 26 abuts against a pin 36 fixed to the housing 10 and a similar pin 37 which is visible in FIG. 3. In this manner the table 26 is detachably connected to the housing 10.

Two guide rods 38 and 40 are fixedly supported by the table 26 and are parallel to each other and to the slot 28. A pusher member 42 is reciprocally movable parallel to the slot 28 and has a bushing 44 fixed thereto through which the guide rod 40 slidably extends. A roller 46 carried by the pusher member 42 rides on the guide rod 38.

The pusher member 42 is formed with pusher arms 48 and 50 which vertically extend through the slot in the table 26 which is not visible and the slot 28 respectively.

Two pulleys 52 and 54 which have the same radius are rotatably mounted to the table 26 and an endless belt 56 is trained therearound so as to be disposed in a vertical plane which is parallel to the slot 28. The pulleys 52 and 54 and belt 56 may be replaced by a sprocket and chain assembly or similar means which provides the same purpose. A connecting member 58 is connected to the inner face of the belt 56 and also to the pusher member 42 by means of a pin 60 which rotatably engages in a hole 62 formed in the pusher member 42. The distance between the point of connection of the connecting member 58 to the belt 56 and the point of connection thereof to the pusher member 42 (the center of the pin 60) is equal to the effective radius of the pulleys 52 and 54 and is designated as *r*.

A gear 64 is fixed to the pulley 52 for rotation therewith. The gear 64 meshes with a gear 66 rotatable mounted within the housing 10. The gear 66 is connected through a friction clutch 70 to a drive gear 68 which is driven for rotation by a drive motor (not shown).

An actuator for the clutch 70 comprises a pawl 72 which is engagable therewith and rotatable about a pivot 74. An electric solenoid 76 has a plunger 78 which is connected to the other end of the pawl 72. The solenoid 76 is controlled by position sensor means including a photoelectric light source 80 and receiver 82 arranged within the housing 10 near the inlet opening 16.

The operation of the apparatus will now be described with reference to the drawings.

The drive gear 68 is driven by the motor (not shown) at a constant speed, and the solenoid 76 is normally de-energized so that the pawl 72 engages with the clutch 70 to disengage or prevent rotation of the same. In this manner, although the drive gear 68 rotates, the gear 66 is prevented from rotation and thereby the belt 56 and pusher member 42 do not move. The pinch rollers 20 and 22 are also de-energized. The pusher member 42 is maintained in an initial position as shown in FIG. 1.

To feed the transfer sheet 5 into the housing 10, the sheet 5 is placed with the transfer image facing upward either automatically or manually on the table 26 as shown in FIG. 1. Any cleaning or correction operations may be performed while the sheet 5 is on the table 26. The sheet 5 is then slid partially into the housing 10 either by a supplementary automatic means (not shown) or the apparatus operator so that the left edge of the sheet 5 (in FIG. 1) interrupts the light beam between the source 80 and receiver 82. This causes the solenoid 76 to be actuated to move the pawl 72 out of engagement with the clutch 70 thereby connecting the gear 66 for rotation with the drive gear 68. The gears 66 and 68 rotate clockwise thereby driving the gear 64 and pulleys 52 and 54 counterclockwise. This results in the belt 56 being driven as shown by arrows. The belt 56 moves the pusher member 42 leftward so that the pusher arms 48 and 50 engage with the right edge (in FIG. 1) of the sheet 5 and push the same into the housing 10. The sheet 5 slides over the plate 14 and is heated by the heater assembly 12 which thermally fixes the transfer image thereto. When the left edge of the sheet 5 engages with the microswitch 24, the pinch rollers 20 and 22 are energized to move the sheet 5 leftward out of the housing 10 through the outlet opening 18 to a receiving tray (not shown). The microswitch 24 may be provided with a timer (not shown) to energize the pinch rollers 20 and 22 for a length of time sufficient for the sheet 5 to be fed out of the housing 10.

It will be noted that the pin 60, which rotatably engages in the hole 62 in the pusher member 42 lies in the same horizontal plane as the centers of the pulleys 52 and 54. This relationship is maintained for all rotational positions of the pulleys 52 and 54 and positions of the belt 56 regardless of whether the point of connection of the connecting member 58 to the belt 56 is above or below the pin 60. In this manner, constant rotation of the pulleys 52 and 54 will cause reciprocation of the pusher member 42 from the initial position shown in FIG. 1 to a position closest to the housing (not shown). The solenoid 76 may comprise a timer or similar means (not shown) to move the pawl 72 away from the clutch 70, when energized by the blockage of the light beam between the source 80 and receiver 82 for a length of time sufficient for the pusher member 42 to make one reciprocation from its initial position and back again. Other means well known in the art such as limit switches (not shown) may provide the same function.

In accordance with the present invention it will be seen that the sheet 5 is fed into the housing 10 by the pusher arms 48 and 50 so that the edges of the sheet 5 are parallel to the feed direction, since the pusher arms 48 and 50 are parallel and spaced from each other. The pusher arms 48 and 50 may of course be replaced by a single wide pusher arm although not shown. The pulleys 52 and 54 and belt 56 may be replaced by any other means to reciprocally move the pusher member 42.

The sensor means comprising the light source 80 and receiver 82 may be replaced by, for example, a switch (not shown). After the sheet 5 is placed on the table 26, the switch may be actuated either automatically or manually to energize the solenoid 76. This modification would eliminate the need to partially insert the sheet 5 into the housing 10 past the light source 80 and receiver 82.

Other modifications will become possible to those skilled after receiving the teachings of the present invention.

What is claimed is:

1. In a transfer sheet fixing apparatus having a housing provided with an inlet opening, the combination therewith of a transfer sheet conveyor comprising;

a table mounted adjacent to the inlet opening and having a longitudinal slot formed therethrough longitudinally aligned with the inlet opening;

a pusher member extending through the slot; and drive means including a belt and pulley assembly supported by the table for reciprocally moving the pusher member, the belt and pulley assembly comprising an endless belt arranged parallel to the slot and connected to the pusher member, two pulleys training the belt therearound and having the same radius, a first gear fixed for rotation with one of the pulleys, and a second gear rotatably supported by the housing and meshing with the first gear.

2. The apparatus according to claim 1, in which the drive means for further comprises a clutch connected to the second gear.

3. The apparatus according to claim 2, in which the drive means further comprises actuator means for engaging and disengaging the clutch, and transfer sheet position sensor means for controlling the actuator means.

4. The apparatus according to claim 3, in which the actuator means comprises a solenoid.

5. The apparatus according to claim 1, in which the belt is arranged in a vertical plane, the belt and pulley assembly further comprising a connecting member connecting the belt to the pusher member, the distance between points of connection of the connecting member to the belt and pusher member being substantially equal to the radius of the pulleys.

6. The apparatus according to claim 1, in which the drive means further comprises a clutch connected to the belt and pulley assembly and actuator means for engaging and disengaging the clutch.

7. The apparatus according to claim 6, in which the actuator means comprises a solenoid.

8. The apparatus according to claim 6, in which the drive means further comprises sensor means for controlling the actuator means.

9. The apparatus according to claim 8, in which the sensor means comprises a photosensor assembly mounted near the inlet opening.

10. The apparatus according to claim 1, in which the table and pusher member are detachably mounted to the housing.

11. The apparatus according to claim 1, in which the table comprises an elongated guide member arranged parallel to the slot, the pusher member being slidably connected to the guide member.

12. The apparatus according to claim 1, in which the fixing apparatus has an outlet opening, and which further comprises, in combination, a feed roller assembly mounted near the outlet opening.

13. The apparatus according to claim 12, further comprising transfer sheet position sensing means for controlling the feed roller assembly.

* * * * *